US005341942A

United States Patent [19]

James, Jr.

[11] Patent Number: 5,341,942

[45] Date of Patent: Aug. 30, 1994

[54] APPARATUS FOR SUPPORTING AND DISPLAYING OBJECTS

[76] Inventor: William D. James, Jr., 2305 Tenbrook Rd., Arnold, Mo. 63010

[21] Appl. No.: 37,312

[22] Filed: Mar. 25, 1993

[51] Int. Cl.[5] ..... A47F 7/00

[52] U.S. Cl. ..... 211/40; 211/94; 40/124

[58] Field of Search ..... 211/40, 41, 87, 94; 40/124; 312/9.9

[56] References Cited

U.S. PATENT DOCUMENTS

| | | | |
|---|---|---|---|
| D. 180,641 | 7/1957 | Edmondson | D33/10 |
| D. 211,188 | 5/1968 | Florane | D33/3 |
| D. 213,407 | 2/1969 | Levy | D80/9 |
| D. 239,231 | 3/1976 | Cockcroft | D6/157 |
| D. 321,291 | 11/1991 | Shoemaker, Jr. | D6/407 |
| D. 322,725 | 12/1991 | Strickland, III | D6/407 |
| 1,303,299 | 5/1919 | Hahl | 211/40 |
| 3,254,927 | 6/1966 | Harvey | 312/10 |
| 4,102,458 | 7/1978 | Fors | 211/40 X |
| 4,573,749 | 3/1986 | Massaro | 211/40 |
| 4,867,306 | 9/1989 | Factor | 206/309 |
| 4,919,287 | 4/1990 | Haskett et al. | 211/41 |
| 4,940,147 | 7/1990 | Hunt | 211/40 |
| 4,951,826 | 8/1990 | Tomkins | 211/40 |
| 5,040,687 | 8/1991 | Whittington | 211/40 |
| 5,052,564 | 10/1991 | Zuzack | 211/40 |
| 5,072,836 | 12/1991 | Gross | 211/40 |
| 5,078,270 | 1/1992 | Campbell | 206/444 |
| 5,105,952 | 4/1992 | Krattiger | 211/41 |
| 5,148,925 | 9/1992 | Althoff et al. | 211/41 |
| 5,215,198 | 6/1993 | Sutton | 211/40 |
| 5,259,517 | 11/1993 | Pancoe | 211/41 |

*Primary Examiner*—Robert W. Gibson, Jr.
*Attorney, Agent, or Firm*—Charles A. Bevelacqua

[57] ABSTRACT

This invention discloses a support and display apparatus for supporting and displaying disc-like objects of predetermined size and shape, the support and display apparatus comprising at least one elongated structural member having a width, a thickness, a length, and an upper surface, the length of the elongated structural member being at least equal to an overall dimension of a face of a disc-like object which is to be supported and displayed, the structural member having a uniform continuous groove formed in its upper surface, the continuous groove having a bottom surface and opposed front and back sides, the front and back sides being spaced from each other at any opposed corresponding point by a space at least equal to the thickness of a disc-like object which is to be supported and displayed.

The structural members may be joined together to support and display a relatively large array of disc-like objects.

11 Claims, 2 Drawing Sheets

FIGURE 6
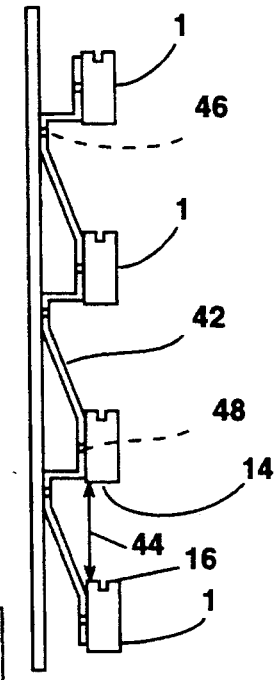
FIGURE 7
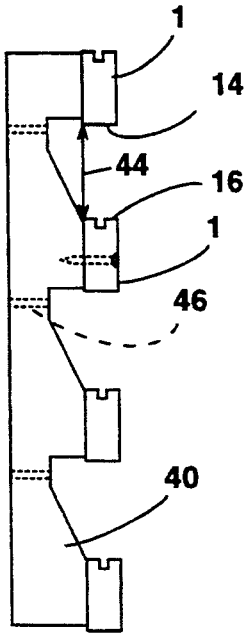
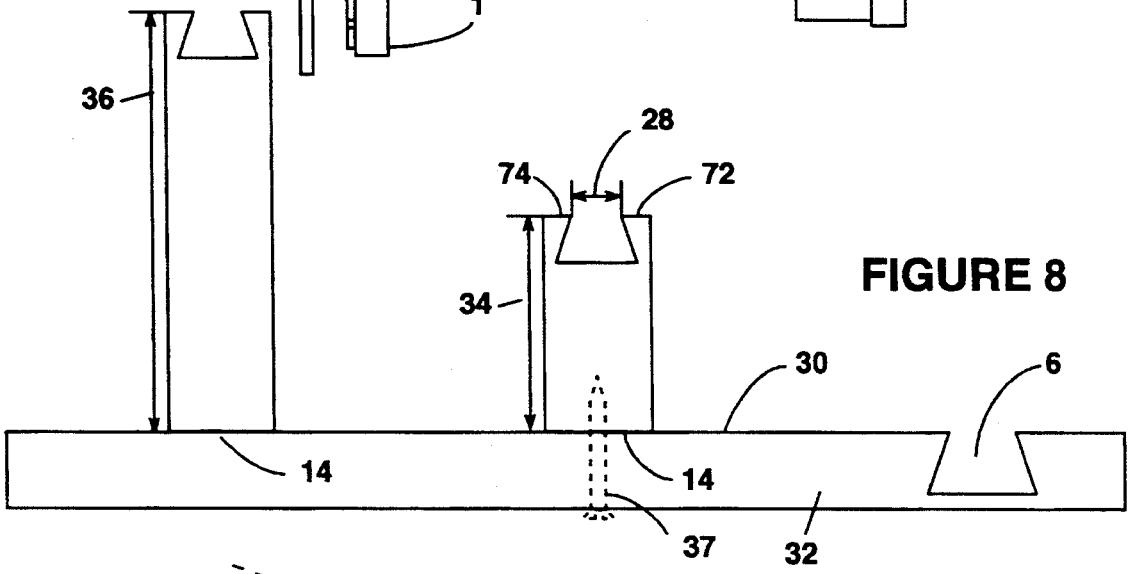
FIGURE 8
FIGURE 9
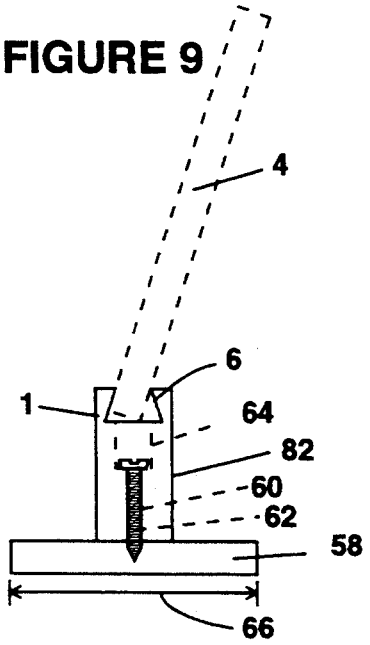
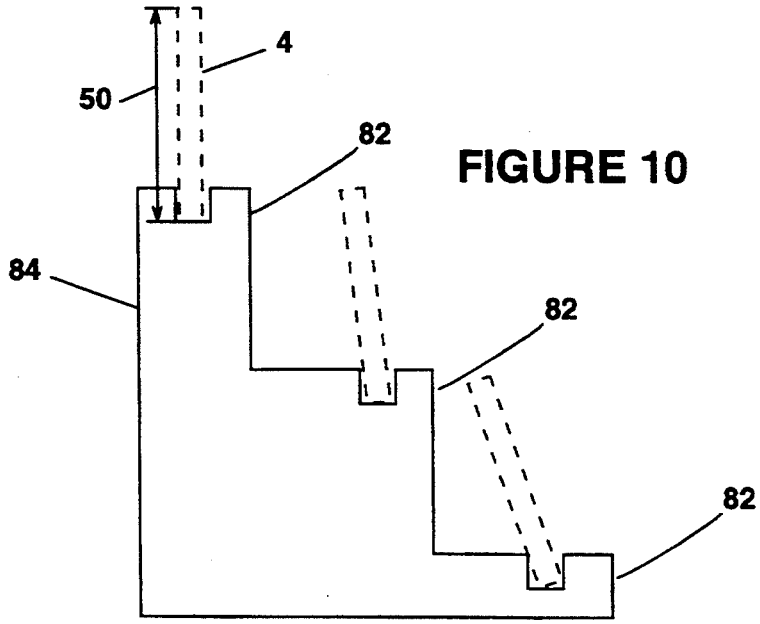
FIGURE 10

APPARATUS FOR SUPPORTING AND DISPLAYING OBJECTS

FIELD OF THE INVENTION

This invention relates to apparatus for supporting and displaying objects which are discs or disc-like in shape, for example, the containers holding compact discs. While the invention is illustrated and described in reference to compact discs in a container or case it should be understood that it can be readily applied to store or support and display any object of a finite size and shape, particularly one which is disc-like, that is, one which is relatively thin in comparison to its length and width and especially such a disc-like object which has opposed rectilinear surfaces.

References to a compact disc or compact disc case are intended to refer to any such object which has a relatively small thickness compared to its length and width.

BACKGROUND OF THE INVENTION

In the case of a compact disc, for example, the case for the disc, in addition to holding the compact disc which contains the recorded sound, is provided on its face with a photographic or artistic display which is designed to convey a certain mood or impression or to enhance the appearance of the disc to make it aesthetically appealing. Therefore it is advantageous to have an apparatus for supporting and displaying compact discs in a manner which will make the artistic display, usually present on the face of the disc, prominently and fully visible.

It is desirable to support or store the compact disc in its case in apparatus which provides a fully visible display and also provides easy and ready access to the stored objects so they can be easily inserted or removed from the apparatus. In some cases disc cases placed vertically may also create a glare or reflection which may partially obscure the art work contained inside the case, particularly as is usual, when the case is made of a clear, smooth plastic. The ability to support a compact disc case at an angle helps to alleviate this condition. It is also found that the angle at which the displayed compact discs should be supported for optimum viewing will depend to a substantial extent on whether the discs are at, above or below the line of vision of the viewer. A disc case above the line of vision of the viewer may be seen best if it leans forward at the top, while one below the line of vision of the viewer may be best viewed if it leans back at the top. If a disc case is at the viewer's eye level it may be best seen if held in a vertical position.

Previous attempts have been made to provide apparatus for storing compact discs but most of the prior apparatus is capable of supporting a disc only at a single fixed angle which may or may not be best suited for the prevailing conditions.

In other prior art structures the compact disc case is attached to a display rack by adhesive or other securing means such as hook and loop fabric and/or the cases are held in such manner that they cannot be easily gripped with the fingers for removal of a particular case from a display without disrupting or removing other cases. Some of the prior art devices require complex structures which are difficult and expensive to manufacture and difficult to use.

Finally, many of the prior art device have retaining means or frames extending around two or more sides of the case so that they obscure a substantial portion of the art work, thus not taking full advantage of making the display pleasing to the observer.

The instant invention provides simple, effective structure which grips only one edge of a compact disc case and causes minimal obstruction of art work on the face of the disc case.

SUMMARY OF THE INVENTION

This invention discloses a support and display apparatus for supporting and displaying disc-like objects of predetermined size and shape, the support and display apparatus comprising at least one elongated structural member having a width, a thickness, a length, and an upper surface, the length of the elongated structural member being at least equal to an overall dimension of a face of a disc-like object which is to be supported and displayed, the structural member having a uniform continuous groove formed in its upper surface, the continuous groove having a bottom surface and opposed front and back sides, the front and back sides being spaced from each other at any opposed corresponding point by a space at least equal to the thickness of a disc-like object which is to be supported and displayed.

There is also disclosed a support and display apparatus for supporting and displaying disc-like objects of predetermined size and shape having a face which it is desired to display, the support and display apparatus comprising at least one structural member having a width, a length, a thickness, a top surface and a bottom surface, the length of the elongated structural member being at least equal to an overall dimension of a face of a disc-like object which is to be supported and displayed, the structural member having at least one uniform continuous groove formed in its top surface, each continuous groove having a bottom surface and opposed front and back sides, the front and back sides being spaced from each other at any corresponding point by a space at least equal to the thickness of a disc-like object which is to be supported and displayed.

There is further disclosed a support and display apparatus for supporting and displaying a disc-like object of predetermined size and shape, the support and display apparatus comprising at least first and second elongated structural members, each of the structural members having a width, a length, a thickness, a front face, a rear surface, a top surface and a bottom surface and having a substantially uniform rectangular cross-section, a uniform continuous groove formed in the top surface of each structural member, the groove having a bottom surface, the structural members being joined together by at least one joining member contacting at least a portion of one of their front faces or rear surfaces, a top surface of one of the structural members being in spaced vertically opposed relation with the bottom surface of another of the structural members, and the distance between such bottom surface and the bottom surface of the groove in an adjoining structural member being at least equal to the vertical dimension of a disc-like object to be supported and displayed.

In its basic form as shown in FIGS. 1, 2 and 3 the invention is constructed from a single integral piece of material which may be wood, plastic or other material suitable for being molded, cast, or machined into the desired shape as a unitary structural member. These basic members can be combined into a series or group of integral or separate structural members to accommodate larger displays. Structural members can be made in forms that can be supported on a wall or other vertical surface or which can be placed on a horizontal surface, such as a table top or other furniture, or on a shelf or glass display case such as used in a retail store. The structural members may also be joined together or integrally formed to produce apparatus in a stepped form which will permit several rows of discs to be displayed with clear vision of each row and which can either be supported on a vertical surface or on a horizontal surface.

In another form of the invention particularly adapted for placement on a horizontal surface, one or more structural members may be attached to a horizontal base. It will be seen that the support grooves may be formed directly on a horizontal base or may be formed on structural members of different heights attached to a horizontal base to display several rows of compact discs all of which are fully visible from the front.

The present invention supports a compact disc in such a manner that very little if any of the artistic display on the front of the disc is obscured by the structure for supporting the disc and provides a user the option of displaying the disc at an angle from the vertical which angle is almost infinitely adjustable between predetermined maximum deviations from the vertical.

It is an object of this invention to provide support and display apparatus for supporting and displaying compact discs or other disc-like objects in a readily accessible and highly visible manner.

It is another object of this invention to provide such apparatus which can be easily and economically manufactured.

Another object of this invention is to provide such apparatus which can be made or formed in a single integral piece.

Still another object of this invention is to provide such apparatus which can support and display a plurality of rows of compact discs or disc-like objects without any of the objects in any of such rows obscuring any part of another row of discs or objects being displayed.

It is a further object of this invention to provide apparatus for supporting and displaying a disc-like object which apparatus may be supported either from a vertical surface or on a horizontal surface.

Another object of this invention is to provide apparatus for supporting and displaying one or more rows of disc-like objects which can be supported on a horizontal surface and which does not require marring or otherwise damaging the support surface.

BRIEF DESCRIPTION OF THE DRAWINGS

FIGS. 6 and 7 show two other examples of structures for combining vertically oriented multiple structural members.

FIG. 8 shows a form of the invention in which multiple structural members are horizontally oriented and illustrating how a groove may be applied to a relatively broad surface of a structural member.

FIG. 9 illustrates the invention in a form in which a structural member is attached to a base for mounting on a horizontal surface.

FIG. 10 shows a form of the invention which can be wall or table mounted.

DESCRIPTION OF THE PREFERRED EMBODIMENTS

Figure 1:
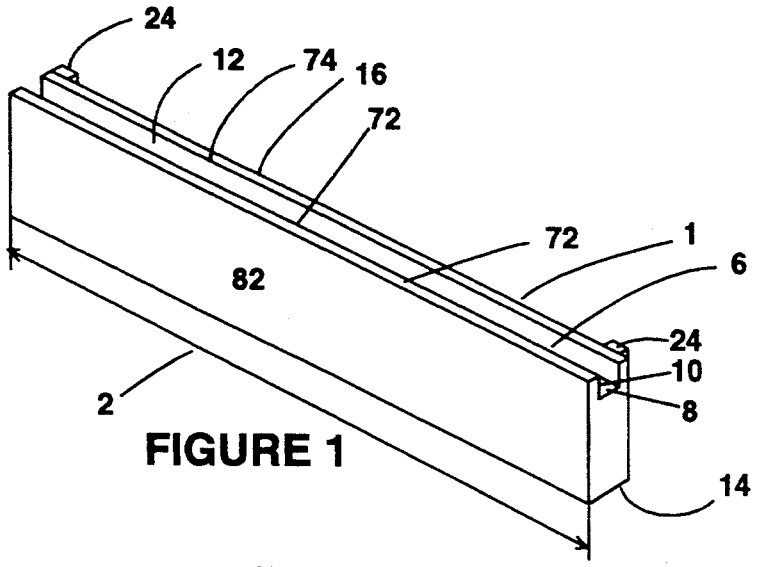
FIG. 1 is an isometric view of a preferred basic form of the invention.

Prior to proceeding to a more detailed description of the various preferred and alternative embodiments of the present invention it should be noted that, for the sake of clarity, identical components which have identical functions have been identified with identical reference numerals throughout the several views illustrated in the drawings.

Turning now to FIG. 1 there is shown a presently preferred form of the invention comprising a unitary structural member generally designated by the numeral 1 made from an elongated piece of material having a length 2 at least equal to the dimension of the portion of a disc-like object 4, which may be a compact disc, to be engaged by the apparatus or a multiple of such dimension.

Figure 2:
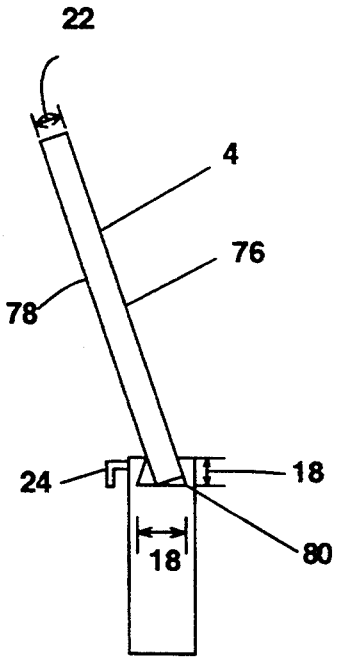
FIG. 2 is an end view of the invention as shown in FIG. 1 with a compact disc in supported position.

Structural member 1 has a front face or surface 82 and a rear face or surface 84. The structural member 1 is made with a continuous groove 6 which has a bottom surface 8, a front side 10 and a back side 12. The structural member has a bottom surface 14 and a top surface 16, with the groove 6 being formed in the top surface 16 and extending vertically downwardly a depth 18. The intersection of the front side 10 of groove 6 and top surface 16 forms a front corner 72 and the intersection of back side 12 of groove 6 and top surface 16 forms a rear corner 74. The width 20 of groove 6 is somewhat greater than the thickness 22 of a compact disc case 4. As an example, a compact disc case is shown in FIG. 2 as having a front side 76, a rear side 78, and bottom corners 80. The excess width 20 of groove 6 provides the user a choice of placing the disc in the groove either in a rearwardly inclined position as indicated in FIG. 2, a substantially vertical position as shown at the left side in FIG. 10 or in a forwardly inclined position as illustrated in FIG. 9.

It should be understood that the compact disc can be stabilized and supported in a variety of angles at the option of the user as partially indicated in FIG. 10 as long as there is contact between at least two of the following: front and rear corners 80 of the disc and the front and rear sides 76 and 78 respectively of the disc; and at least two of the bottom 8, the front and rear sides 10 and 12 respectively of the groove 6, and front and rear corners 72 and 74 respectively of the structural member.

The ability to incline the object 4 at various angles provides a means of combatting potential glare that obscures the object being displayed and also permits the object 4 being displayed to be positioned optimally for viewing depending on whether it is at the viewer's eye level, when it may be desirable to display the object in a vertical position, below eye level, when it may be desirable to display the object inclined away from the viewer, or above eye level when it may be desirable to incline the object at an angle toward the viewer. As illustrated in FIGS. 1 and 2 the structural member 1 may be provided with hanging means or brackets 24 for supporting the structural member from a wall or other vertical surface. The hanging means 24 may comprise a metal bracket or any other suitable known means useful to secure the member 1 to a vertical surface.

Figure 3:
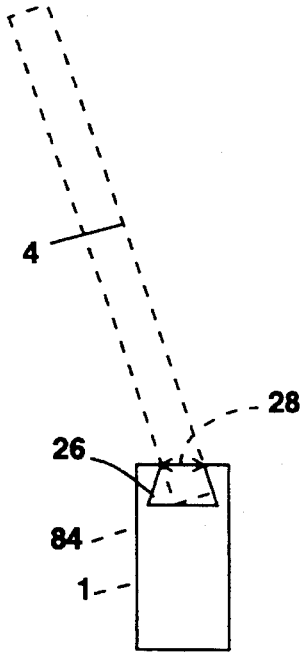
FIG. 3 is an end view of the invention partly in cross-section with a dove-tail shaped groove.

It may be desirable in some cases to form the groove 6 in a dovetail cross-section 26 as is illustrated in FIG. 3. When a dovetail-shaped groove is used, the distance 28 at the narrowest point of the dovetail is made slightly larger than the thickness 22 of the object being displayed and may provide better support for articles displayed in a vertical position and at the various angles in which the object may be displayed than is provided by a rectangularly shaped groove.

Turning now to FIG. 8 there is shown an alternative form of the invention in which the structural member 1 has a relatively broad top surface 30 and a relatively broad bottom surface 32 and the groove 6 or a series of them is formed in the top surface 30. It is possible also to add structural members of the type shown in FIG. 1 having varying heights 34, 36 and secured by means such as screws 37 or other suitable means at their bottom edges 14 to the top surface 30. This will permit objects to be displayed in a series of rows at different heights to permit maximum visibility of several rows of objects displayed thereon. This form of the invention has the further advantage that it can be supported on a horizontal surface without requiring attachments by nails, screws, or the like which may mar or otherwise damage the support surface.

Figure 4:
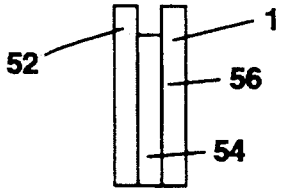
FIG. 4 is an end view of a form of the invention in which the structural member is formed from a plurality of sheets of material.

As illustrated in FIG. 4, structural member 1 may be constructed of two or more pieces of material such as the flat sheets 52, 54 and 56 which are permanently or detachably joined together by any known suitable means. This permits manufacture without machining and adjustment of the relative heights of the front and back sides, 10 and 12 respectively, of the groove to permit adjustment of the maximum angle from the vertical at which an object may be displayed.

Figure 5:
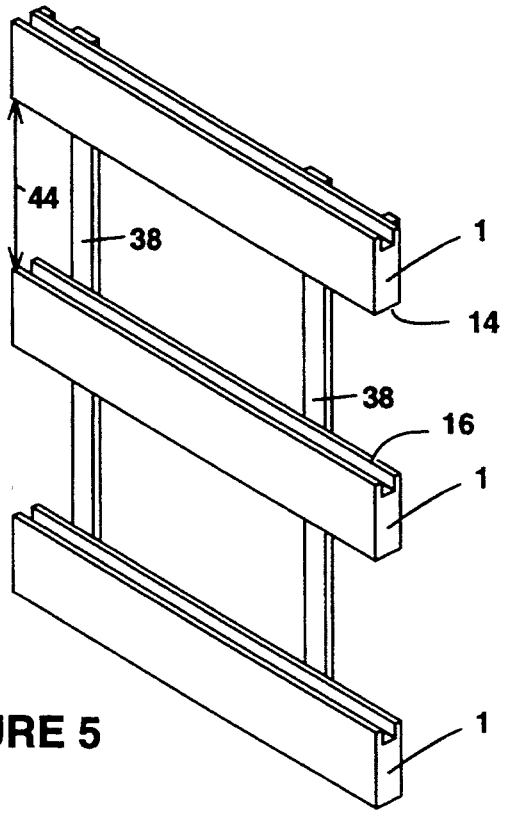
FIG. 5 is an isometric view illustrating one method of combining multiple structural members.

FIG. 5 illustrates the form of the invention shown in FIG. 1 in which multiple structural members 1 are joined together by one or more joining members 38 which are secured by suitable means to support multiple rows of object to be displayed. FIGS. 6 and 7 show alternative forms of joining members designated generally 40 and 42. The joining member 40 may be constructed for example in one piece of wood or plastic and the joining member 42 may be made from a metal strip or molded in one piece from a plastic material. The forms of joining men, hers illustrated in FIGS. 6 and 7 are made so that an object being displayed may be more readily displayed at an angle with the top edge slanted towards a vertical surface from which the apparatus is supported. In the forms of the invention shown in FIGS. 5, 6, and 7 the distance 44 between the bottom edge 14 of one structural member and the top edge 16 of the adjoining structural member is approximately equal to the vertical height 50 of any object to be supported and displayed. The distance may be slightly less than the height 50 and the disc can be place first in the groove 6 and then tilted rearward if desired. Bores or openings 46 may be provided in the joining members 40 and 42 to facilitate attachment of an assembly of structural members and joining members to a wall or other support. Bores or other openings 48 may also be provided to facilitate attachment of structural members 1 to the joining member. Any suitable known means may be employed for attaching structural members 1 to a joining member 40 or 42. It would be possible also to construct an assembly of structural members and joining members as shown in FIGS. 6 and 7 as an integral structure.

Although joining members 38, 40 and 42 are shown as being secured to the rear surfaces 84 of structural members 1, it would be possible to attach the joining members to the front face 82 or to the top or bottom surfaces 16 and 14 respectively or to provide projections or portions, not shown, on the joining members which can be attached to the top, bottom or front surfaces of the structural members.

The joining members may be placed at each end of the structural members or may be spaced from the ends of the structural members as illustrated in FIG. 5. If desired joining members may be spaced along the length of the structural members so that their vertical centerlines will be approximately at the end of each disc-like member being supported. This would insure that in addition to being supported in the groove 6, an object being supported could also have an upper corner supported by a joining member when the object is inclined toward a joining member about an axis parallel to the length of the groove 6. It will be seen that the joining members will be effective to limit inclination of an object as described above if they are spaced from each other slightly more than twice the length of the objects being supported for a display in which the objects are displayed in substantially end to end relationship.

FIG. 9 illustrates a form of the invention in which the structural member 1 is attached by suitable means to a base 58 so that the structural member may be supported on a flat surface such as a table, shelf or a glass display case as indicated in the drawing. The structural member 1 may be provided with one or more bores 60 which will receive an attaching means such as screw 62 to secure the structural member 1 to the base 58. An enlarged bore 64 may be provided to receive the head of the screw so that it will be recessed from the bottom surface of the groove 6 and not interfere with the support and positioning of an object 4 being supported and displayed. The width 66 of base 58 is sufficient to provide stability against tipping of the structural member and the base 58 when the groove 6 is occupied by the maximum number of objects which it is designed to hold and the objects are tilted from the vertical in the same direction by the maximum permissible amount. This condition of maximum tilt is shown in FIG. 9. It should be understood that various other known means may be employed to attach structural member 1 to the base 58 and that a plurality of structural members may be secured to the base 58 with the width 66 being sized accordingly.

FIG. 10 illustrates a form of the invention which may be supported on either a horizontal surface or a vertical surface. It comprises a series of structural members which have the rear surface 84 of one structural member secured to the front face 82 of a contiguous structural member. Two or more structural members may be joined together or may be integrally formed from a single piece of material as illustrated in FIG. 10. Suitable means, not shown, of any known form may be provided for securing the combined structural members to a vertical surface. Also, as shown in FIG. 10 each structural member may be made proportionally higher than the adjacent structural member in front of it in a stepped manner so that the discs displayed in a front row do not obstruct the view of the row of objects behind it.

It should be noted that although the groove 6 in the structural members 1 has been illustrated as having front side 10 and back side 12 of the same configuration, such as rectangular or dovetail, it is within the scope of the invention to have the front and back sides of alternate configurations and of non-rectilinear configurations as well. It will be apparent to those skilled in the art that although examples of various materials such as wood, plastic and metal have been recited and the structural members have been shown as solids it is not intended that these examples be considered limitations of the invention and it will occur to those skilled in the art that the invention may be made of other materials and that parts of the apparatus may be made hollow.

A specific example of a preferred embodiment of the invention as shown in FIG. 1 and intended for use in supporting and displaying compact discs in their cases is set forth below. Assuming a compact disc case which has a thickness 22 of about 0.375 inches, a vertical height 50 of about 4.937 inches and a length of about 5.625 inches, a structural member 1 of FIG. 1 may have a length 2 of about 17 inches, a groove 6 having a width 20 of about 0.50 inches and a depth 18 of about 0.375 inches. It should be understood that the dimensions for a structural member may vary based on the dimensions and shape of the object to be supported and displayed, the desired minimum and maximum permissible angles of inclination of such object and the shape selected for the groove 6. It is found that a groove with a depth 18 less than about 0.065 inches, cannot adequately support a compact disc case in the manner described above.

While specific preferred and alternative embodiments of the invention have been shown and described, it should be understood that many variations and adjustments may be made to the specific arrangements and dimensions described and illustrated without departing from the scope of the invention as defined by the following claims.

I claim:

1. A support and display apparatus for supporting and displaying a disc-like object of predetermined size and shape, said support and display apparatus comprising:

at least first and second elongated structural members, each having a width, a length, a thickness, a front face, a rear surface, a top surface and a bottom surface and having a substantially uniform generally rectangular cross-section, a uniform continuous groove formed in the top surface of said at least first and second structural members, said groove having a bottom surface defining the depth of said groove measured from the top surface of the structural member in which it is formed, said at least first and second structural members being joined together, with a top surface of one of said at least first and second structural members being in spaced vertically opposed relation with the bottom surface of another of said at least first and second structural members, by at least one joining member contacting at least a portion of one of their front face and rear surface, and the distance between a bottom surface of said one of said at least first and second structural member and a bottom surface of a groove formed in the vertically opposed top surface of an adjoining one of said at least first and second structural members being at least equal to the vertical dimension of a disc-like object to be supported and displayed.

2. A support and display apparatus as set forth in claim 1 wherein said at least one joining member comprises a relatively thin sheet material secured to the rear surfaces of each of said at least first and second structural members.

3. A support and display apparatus as set forth in claim 1 wherein said apparatus comprises first and second structural members and further comprises means for securing at least one of said first and second structural members to a rigid support in a substantially vertical plane and said at least one joining member is constructed of a material sufficiently rigid to support the upper one of said first and second structural members in a substantially vertical plane when only the lower one of said first and second structural members is secured to such rigid support and said upper one of said first and second structural members is supporting and displaying the maximum number of disc-like objects which can be placed in the groove in its top surface.

4. A support and display apparatus as set forth in claim 1 wherein said at least one joining member comprises at least two substantially rigid members secured to each of said at least first and second elongated structural members and said at least two substantially rigid members are located with their longitudinal centerlines spaced apart from each other in a direction measured along a length of said elongated structural members a distance less than three times the dimension in the same direction of a disc-like object to be supported and displayed in said support and display apparatus, whereby at least one top corner of each disc-like object will contact a portion of one of said substantially rigid members upon angular movement of such disc-like object in said continuous groove about an axis parallel to the length of said continuous groove, thereby to limit such angular movement of such disc-like object in at least one direction to a predetermined maximum.

5. A support and display apparatus for supporting and displaying disc-like objects of predetermined size and shape, said support and display apparatus comprising:

at least one elongated structural member having a width, a thickness, a length, and an upper surface, said length of said elongated structural member being at least equal to an overall dimension of a face of a disc-like object which is to be supported and displayed, said elongated structural member having a uniform continuous groove formed in its upper surface, said continuous groove having a bottom surface and opposed front and back sides, said front and back sides being spaced from each other at any opposed corresponding point by a space at least equal to the thickness of a disc-like object which is to be supported and displayed, whereby said elongated structural member is capable of supporting in a generally vertical position a disc-like object placed in said continuous groove, and said at least one elongated structural member being formed from at least two parts, each having the same length as said at least one elongated structural member and at least one of said at least two parts also having the same width as said at least one elongated structural member.

6. A support and display apparatus as set forth in claim 5 wherein at least one of said at least two parts includes at least a portion of the bottom surface of said continuous groove.

7. A support and display apparatus as set forth in claim 5 wherein at least one of said at least two parts has a uniform thickness.

8. A support and display apparatus as set forth in claim 5 wherein said at least one structural member is formed from three parts each having a uniform thickness.

9. A support and display apparatus for supporting and displaying disc-like objects of predetermined size and shape, said support and display apparatus comprising:

at least one elongated structural member having a width, a thickness, a lengthy and an upper surface, said length of said elongated structural member being at least equal to an overall dimension of a face of a disc-like object which is to be supported and displayed, said elongated structural member having a uniform continuous groove formed in its upper surface, said continuous groove having a bottom surface and opposed front and back sides, said front and back sides being spaced from each other at any opposed corresponding point by a space at least equal to the thickness of a disc-like object which is to be supported and displayed, whereby said elongated structural member is capable of supporting in a generally vertical position a disc-like object placed in said continuous groove, a horizontal base, each of said at least one elongated structural members further having a bottom surface, and said base being rigidly secured to the bottom surface of each of said at least one elongated structural members whereby to support said at least one elongated structural members in a substantially vertical position.

10. A support and display apparatus as set forth in claim 1 wherein each of said at least one joining members comprises a substantially rigid member secured to each of said structural members and having a plurality of sections, each section including:

a first portion lying parallel to and contiguous with the rear surface of a first structural member, a second portion substantially perpendicular to said first portion and approximately in line with the bottom edge of said first structural member, a third portion substantially perpendicular to said second portion and extending downwardly therefrom in a direction substantially parallel to said first portion, and a fourth portion extending downwardly from said third portion at an obtuse angle thereto to a point approximately in line with the top edge of a second structural member.

11. A support and display apparatus as set forth in claim 10 wherein said third portion of at least one of said sections of at least one of said joining members has means for facilitating attachment of said at least one of said joining members to a substantially vertical support surface, whereby to support said support and display apparatus.

* * * * *